United States Patent [19]

Buse

[11] 4,050,862

[45] Sept. 27, 1977

[54] MULTI-PLUNGER RECIPROCATING PUMP

[75] Inventor: Frederic W. Buse, Allentown, Pa.

[73] Assignee: Ingersoll-Rand Company, Woodcliff Lake, N.J.

[21] Appl. No.: 629,781

[22] Filed: Nov. 7, 1975

[51] Int. Cl.[2] ..... F04B 21/02; F04B 21/04

[52] U.S. Cl. ..... 417/539; 417/454; 92/128

[58] Field of Search ..... 92/165, 128; 417/454, 417/273, 534, 521, 539

[56] References Cited

U.S. PATENT DOCUMENTS

| | | | |
|---|---|---|---|
| 879,560 | 2/1908 | Lepley | 417/539 |
| 1,024,919 | 4/1912 | Waterous | 417/539 |
| 2,331,513 | 10/1943 | Stahl | 417/539 |
| 2,956,738 | 10/1960 | Rosenchold et al. | 92/165 |
| 2,962,975 | 12/1960 | Camp | 417/521 |
| 3,238,604 | 3/1966 | Reinarz | 417/539 |
| 3,364,871 | 1/1968 | Wilson | 417/539 |
| 3,496,880 | 2/1970 | Wolff | 417/273 |
| 3,692,434 | 9/1972 | Schnear | 417/273 |
| 3,817,663 | 6/1974 | Zehner | 417/454 |
| 3,985,475 | 10/1976 | Gatecliff | 417/539 |

*Primary Examiner*—William L. Freeh
*Attorney, Agent, or Firm*—Bernard J. Murphy

[57] ABSTRACT

A multi-plunger reciprocating pump comprising a generally horizontally extending crankshaft and a plurality of generally horizontally extending cylinders alternately disposed at least generally above and below the centerline of the crankshaft. An oil pan is detachably mounted in the crankshaft housing below the crankshaft, whereby the oil pan is readily removable to facilitate axial removal of the crankshaft; and the crossheads connecting the crankshaft driven connecting rods to the piston rods are slidably mounted by bearing shoes adapted to be rotated 90° for facilitating access thereto. Also, the suction and discharge valves for the cylinders are readily accessible without disconnection of any of the piping or manifolds of the pump.

21 Claims, 6 Drawing Figures

MULTI-PLUNGER RECIPROCATING PUMP

The present invention relates to multi-plunger reciprocating pumps and more particularly to the provision of a new and improved pump of this general type.

An object of the present invention is to provide a new and improved multi-plunger reciprocating pump which is particularly constructed and arranged to be relatively compact for the number of included cylinders.

Another object of the invention is to provide a new and improved pump of the type set forth which is particularly constructed and arranged to employ a shorter length crankshaft than normal in reciprocating pumps including the same number of cylinders.

Another object is to provide a new and improved pump of the type set forth which is particularly constructed and arranged to permit axial removal of the crankshaft.

Another object is to provide a new and improved pump of the type set forth which is particularly constructed and arranged to permit ready access to the crosshead bearing shoes.

Other objects and advantages of the invention will be apparent from the following description taken in conjunction with the accompanying drawings wherein, as will be understood, a single embodiment of the invention has been given for the purposes of illustration only.

In accordance with the invention, a multi-plunger reciprocating pump may comprise a generally horizontally extending crankshaft, a plurality of generally horizontally extending cylinders alternately disposed at least generally above and below the centerline of the crankshaft, conduit means operatively associated with each of the cylinders for supplying fluid to, and discharging pumped fluid from, the cylinders, valve means for controlling fluid flow through the conduit means to-and-from the cylinders, a piston movably in each of the cylinders for reciprocation therein, and connecting means connecting the crankshaft to the pistons such that rotation of the crankshaft causes driven reciprocation of the pistons in the cylinders.

Referring to the drawings.

Figure 3:
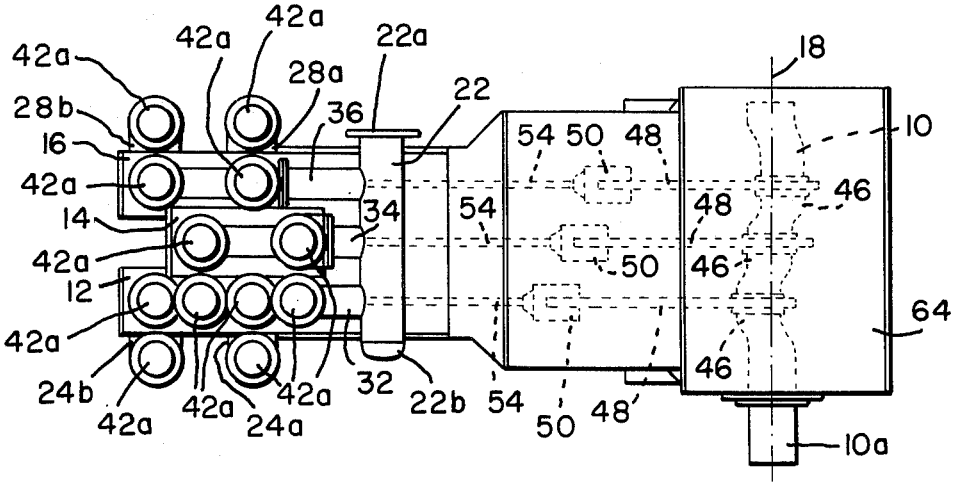
FIG. 3 is a top or plan view of the pump shown in FIGS. 1 and 2.
Figure 2:
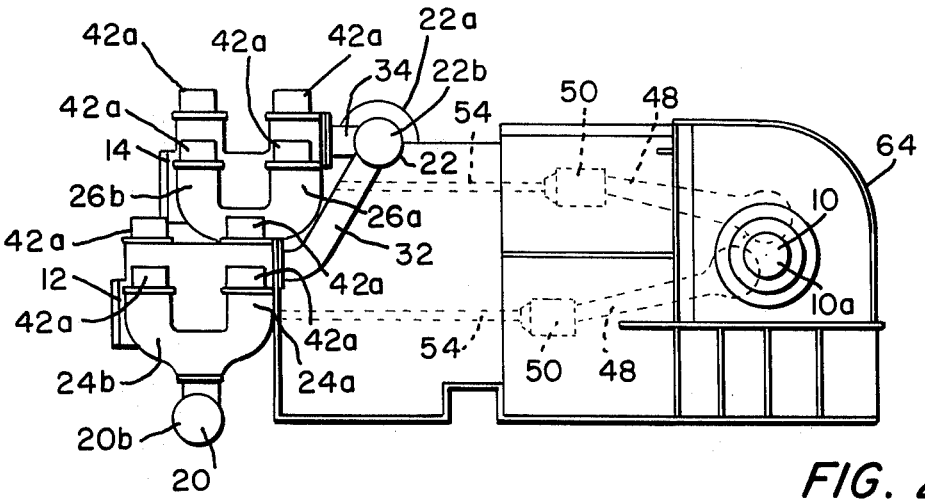
FIG. 2 is an elevational side view of the pump shown in FIG. 1.
Figure 1:
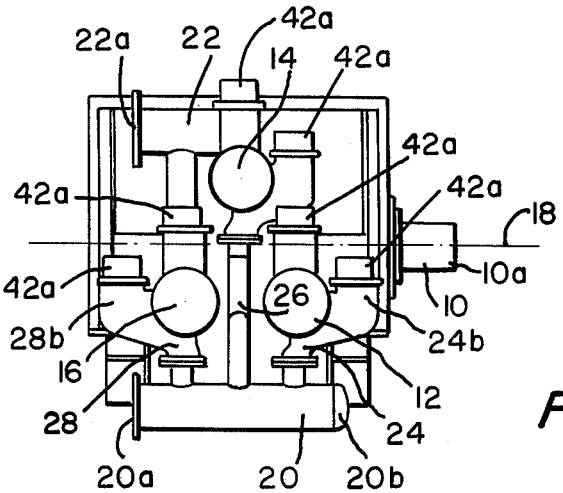
FIG. 1 is an elevational end view of a pump constructed in accordance with the present invention and including three cylinders.

Referring more particularly to the drawings wherein similar reference characters designate corresponding parts throughout the several views, the illustrated multi-plunger pump comprises a crankshaft 10 longitudinally extending at least generally horizontally, and three cylinders 12, 14, 16 which are also arranged to axially extend at least generally horizontally. The crankshaft 10 is rotatably mounted in a conventional manner and, as usual, adapted to be connected at one end 10*a* to a conventional driver (not shown). The cylinders 12, 14, 16 are all disposed on the same side (that is, the left hand side as viewed in FIGS. 2 and 3) of the crankshaft 10 to axially extend in a direction normal or perpendicular to the longitudinal centerline 18 of the crankshaft 10 and alternately arranged at least generally above and below such centerline 18. More particularly, as shown in FIG. 1, the cylinders 12 and 16 are located in spaced apart alignment below the crankshaft centerline 18; and the cylinder 14 is located above such centerline 18 and at least generally between the cylinders 12 and 16. This arrangement of the cylinders 12, 14, 16, as will be seen, enables such to be disposed in a smaller space longitudinally of the crankshaft 10 than would be normally possible in the event that the cylinders were arranged in the conventional side-by-side alignment, thus permitting the employment of a relatively short crankshaft 10 for the number of cylinders included in the pump and making the pump relatively compact for number of included cylinders.

Figure 4:
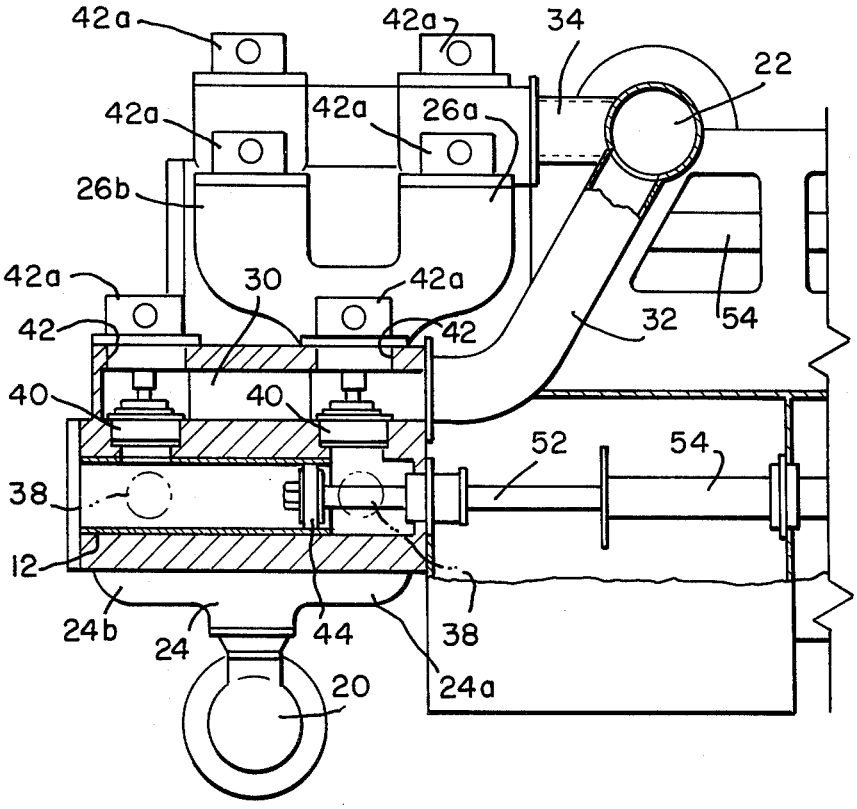
FIG. 4 is an enlarged, fragmentary, elevational sectional view showing one of the cylinders of such pump.

The pump includes inlet and discharge manifolds 20, 22 respectively, to which the cylinders 12, 14, 16 are connected in parallel. The inlet manifold 20 at one end 20*a* is adapted for connection to a source (not shown) of the liquid, slurry, or other fluid to be pumped. The other end 20*b* of the inlet manifold 20 is closed. Supply conduits 24, 26, 28, individually connected to the inlet manifold 20 at intervals along its length, communicate the inlet manifold 20 with the cylinders 12, 14, 16, respectively, each such supply conduit including portions, identified by the reference numeral for the conduit followed by the suffixes "*a*" and "*b*", connected to the opposite ends of its respective corresponding cylinder to be operable for supplying fluid from the inlet manifold 20 alternatively to such opposite ends of the cylinder. The discharge manifold 22 at one end 22*a* is adapted for connection to piping for discharge of the pumped liquid, slurry, or other fluid from the pump, while the other end 22*b* of such manifold 22 is either closed as shown or provided with a conventional pulsation dampening device such as a pulsation bottle (not shown) containing gas at a pressure, for example, two-thirds that of the pumped fluid discharge to the manifold 22. As illustrated in FIG. 4, wherein the cylinder 12 is shown in section for the purposes of illustration, each of the cylinders 12, 14, 16 is provided with a discharge chamber 30 which extends longitudinally along the cylinder and is connected to both ends of the cylinder. The discharge chambers 30 for the cylinders 12, 14, 16 are connected to separate discharge conduits 32, 34, 36 which individually communicate with the discharge manifold 32 at spaced locations along its length for supplying the pumped fluid from the chambers 30 to the manifold 22. Individual suction valves 38, two of which are schematically depicted in broken lines in FIG. 4, are disposed adjacent the connections of the supply conduit portions 24*a*, 24*b*, 26*a*, 26*b*, 28*a*, 28*b* to their respective communicating ends of their corresponding cylinders, for controlling the supply of fluid from the inlet manifold 20 to the ends of the cylinders; and individual discharge valves 40, two of which are shown in FIG. 4, are interposed intermediate the discharge chamber 30 for each cylinder 12, 14, 16 and each end of the corresponding cylinder, for controlling the discharge of pumped fluid from the cylinders 12, 14, 16. The suction and discharge valves 38, 40 are, per se, of conventional construction, biased to normally closed positions in the conventional manner, and adapted to permit supply of fluid from the inlet manifold 20 to either end of each one of the cylinders while permitting simultaneous discharge of pumped fluid from the other end of the cylinder to the discharge manifold 22. A valve access opening 42 is formed in alignment with each of the valves 38, 40 to permit ready access to the valves without the necessity for disconnection of any of the beforedescribed supply and discharge conduits and manifolds, the valve access openings 42 being closed by individual, detachable closure caps 42*a* during the normal operation of the pump.

Figure 6:
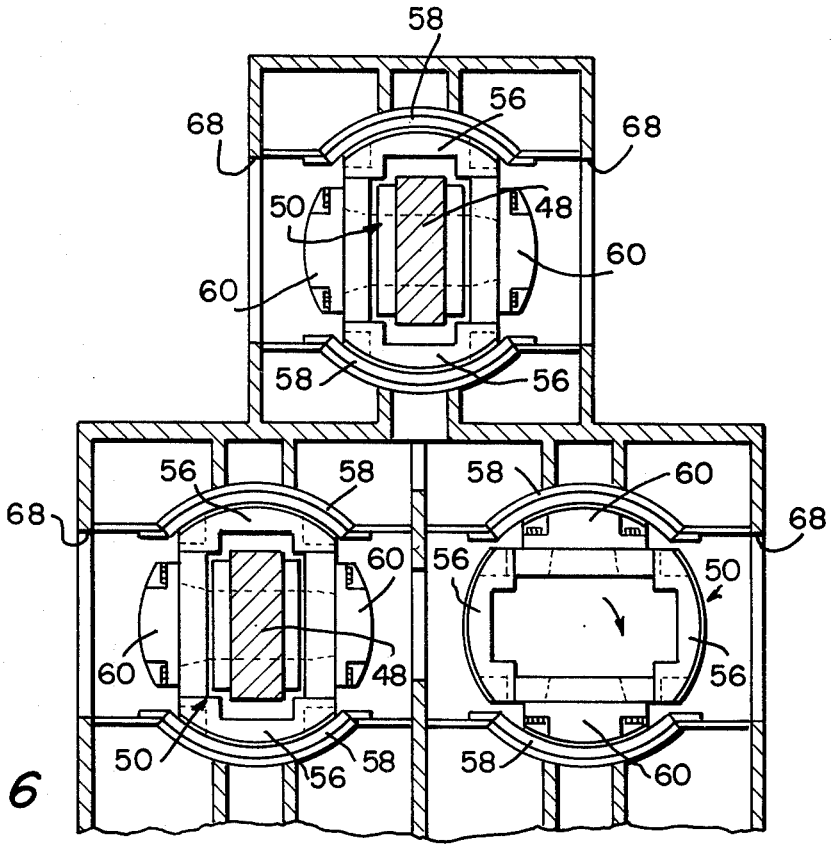
FIG. 6 is an elevational sectional view taken on line 6—6 of FIG. 5 looking in the direction of the arrows, with one of the connecting rods removed.
Figure 5:
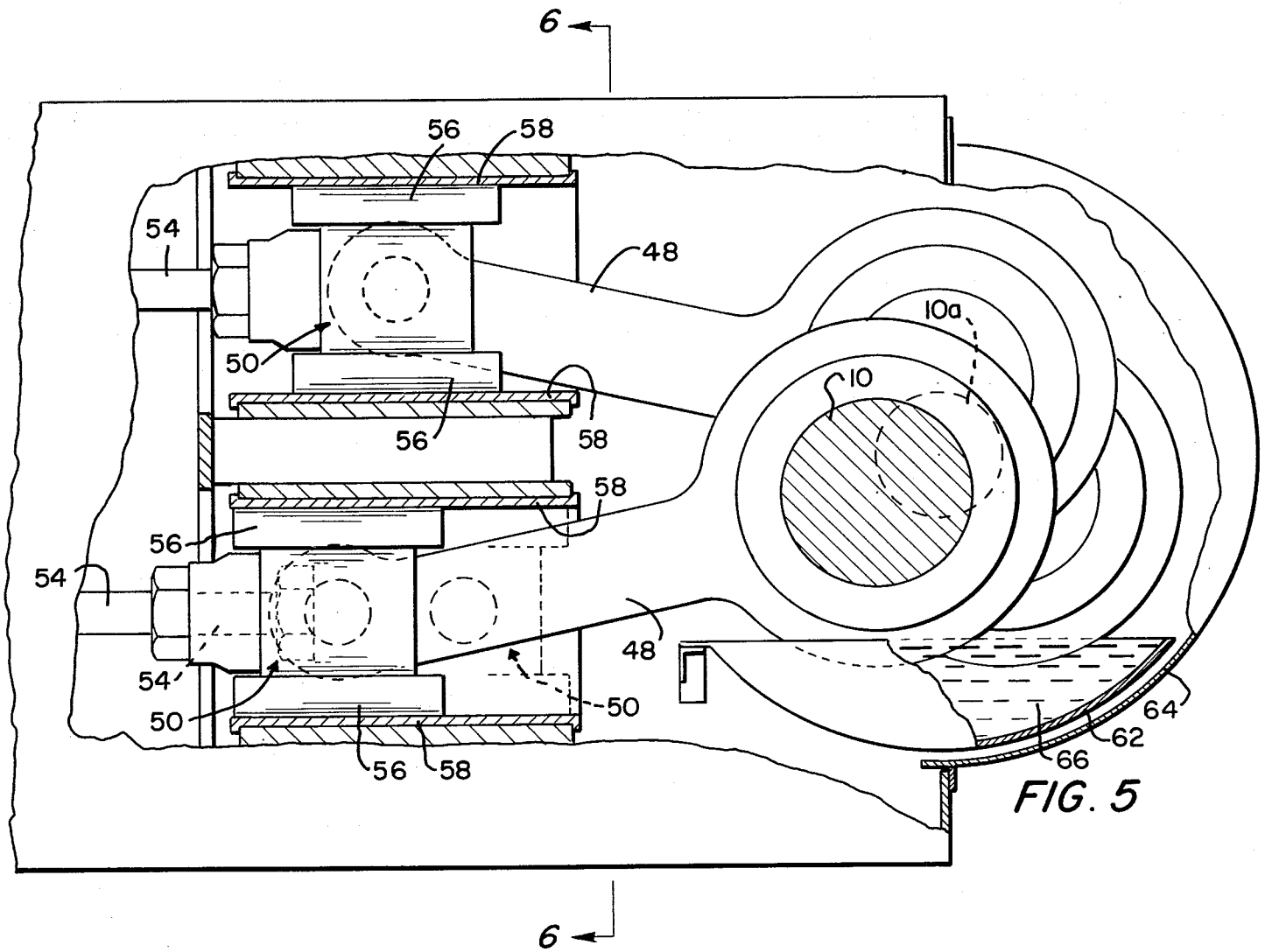
FIG. 5 is an enlarged, fragmentary view showing the crankshaft and associated means for driving the pistons in two of the pump cylinders.

As shown in FIG. 4, a double-acting piston 44 is movably disposed in each of the cylinders 12, 14, 16 for axial reciprocation therein, the pistons 44 being individually connected to their respective offset crankshaft portions 46 of the crankshaft 10 by separate connecting means such that rotation of the crankshaft 10 causes axial reciprocation of the pistons 44 in the cylinders 12, 14, 16. Said connecting means for each piston 44 comprises an offcenter connecting rod 48 connected at one end of the crank portion 46 for the piston 44, and an axially movable crosshead 50 which is pivotally connected to the other end of the connecting rod 48 and slidably supported for axial movement in the direction of the driven movement of the piston 44 in its cylinder. Said connecting means for each piston 44 further comprises a piston rod 52 at one end affixed to the piston 44 and an extension rod 54 which at opposite ends is connected to the piston rod 52 and the crosshead 50. As shown in FIG. 5, each connecting rod 48 is connected to its respective crank portion 46 and crosshead 50 off its center; and, as shown in FIGS. 4, 5 and 6, each crosshead 50 is on two opposite sides provided with arcuate bearing shoes 56 which are slidably supported by corresponding arcuate slide ways 58. In addition, each crosshead 50 further includes two other arcuate supporting shoes 60 disposed intermediate its bearing shoes 56, whereby 90° rotation (as, for example, schematically depicted by the arrow shown in FIG. 6) of each crosshead 50 causes its supporting shoes 60 to support the crosshead 50 on the arcuate ways 58 while freeing the arcuate bearing shoes 56 from such ways 58 and making them readily accessible through access opening 68 for service and/or replacement. Moreover, as shown in FIG. 5, an oil pan 62, separate from the housing 64 enclosing the crankshaft 10, is detachably mounted within the housing 64 below the crankshaft 10. The oil pan 62 during its operation of the pump 10 contains lubricating oil 66 into which the connecting rods 48 are dipped during their driven movement for purposes of lubrication, the detachable mounting of such oil pan 62 permitting their ready removal such that the crankshaft 10 may be more readily axially disassembled from the pump.

Throughout the operation of the pump, the crankshaft 10 is continuously rotatably driven by its driver to cause the crankshaft 10 to drive the double-acting pistons 44 in the cylinders 12, 14, 16 through the connecting rods 48, crossheads 50, extension rods 54 and piston rods 52. Fluid to be pumped is supplied to the inlet manifold 20 and thence flows to the supply conduits 24, 26, 28 which introduce the fluid alternately into each of the ends of their respective connected cylinders 12, 14, 16. Pumped fluid is alternatively discharged from each of the ends of the cylinders 12, 14, 16, while fluid from the supply conduits 24, 26, 28 is supplied into the other ends of the cylinders, to the discharge chambers 30 connected to the cylinders and thence flows through the discharge conduits 32, 34, 36 to the discharge manifold 22 which discharges it from the pump.

From the preceding description it will be seen that the invention provides new and improved means for accomplishing all of the beforestated objects and advantages of the invention. It will be understood however that, although only a single embodiment of the invention has been illustrated and hereinbefore described, the invention is not limited merely to this single embodiment, but rather contemplates other embodiments and variations within the scope of the following claims. For example, double-acting pistons 44 are shown and described. Alternatively, however, plungers would be similarly employable. Too, single-acting pistons, or plungers, and the like, can be used in the practice of the invention. Such alternative embodiments, and others which will occur to those skilled in this art by taking teaching from my disclosure, are deemed to be within the ambit of my invention.

Having thus described my invention, I claim:

1. A multi-plunger reciprocating pump comprising a generally horizontally extending crankshaft, a plurality of generally horizontally extending cylinders alternatively disposed at least generally above and below the centerline of said crankshaft, conduit means operatively associated with each of said cylinders for supplying fluid to, and discharging pumped fluid from, said cylinders, valve means for controlling fluid flow through said conduit means to-and-from said cylinders, a piston movably disposed in each of said cylinders for reciprocation therein, and connecting means connecting said crankshaft to said pistons such that rotation of said crankshaft causes driven reciprocation of said pistons in said cylinders, wherein said connecting means for each said piston comprises a connecting rod connected to said crankshaft to be driven thereby, a piston rod connected to the piston, and a crosshead connecting said connecting rod to said piston rod, and further comprising arcuate way means disposed adjacent two opposite sides of each said crosshead, arcuate bearing shoe means mounted to such two opposite sides of each said crosshead slidably supporting the crosshead on its said way means, and other arcuate shoe means mounted to each said crosshead intermediate its said acruate bearing shoe means, whereby 90° rotation of said crossheads causes said other shoe means to support said crosshead on said arcuate way means.

2. A multi-plunger reciprocating pump according to claim 1, wherein said cylinders are all disposed on the same side of said crankshaft.

3. A multi-plunger reciprocating pump according to claim 1, wherein there are an odd number of said cylinders.

4. A multi-plunger reciprocating pump according to claim 1, wherein there are only three of said cylinders.

5. A multi-plunger reciprocating pump according to claim 4, wherein two of said cylinders are disposed below the centerline of said crankshaft.

6. A multi-plunger reciprocating pump according to claim 1, wherein said conduit means for each of said cylinders comprises supply conduits for supplying fluid to both ends of the cylinder and also discharge conduits for discharging pumped fluid from both ends of the cylinder, and said valve means comprises valves operatively associated with each of said conduits for controlling fluid flow therethrough, said valves for each of said cylinders being adapted to permit supply of fluid to either end of the cylinder while permitting simultaneous discharge of fluid from the other end of the cylinder.

7. A multi-plunger reciprocating pump according to claim 6, further comprising inlet manifold means communicating with said supply conduits for all of said cylinders for supplying fluid thereto, and discharge manifold means communicating with said discharge conduits for all of said cylinders for discharging pumped fluid therefrom.

8. A multi-plunger reciprocating pump comprising a geneally horizontally extending crankshaft, at least three generally horizontally extending cylinders, a first of said cylinders being disposed at least generally above the centerline of said crankshaft and a second of said cylinders being disposed at least generally below the centerline of said crankshaft, conduit means operatively associated with each of said cylinders for supplying fluid to, and discharging pumped fluid from, said cylinders, valve means for controlling fluid flow through said conduit means, a piston movably disposed in each of said cylinders for reciprocation therein, and connecting means connecting said crankshaft to said pistons such that rotation of said crankshaft causes driven reciprocation of said pistons in said cylinders, wherein said connecting means for each said piston comprises a connecting rod connected to said crankshaft to be driven thereby, a piston rod connected to the piston, and a crosshead connecting said connecting rod to said piston rod, and further comprising arcuate way means disposed adjacent two opposite sides of each said crosshead, arcuate bearing shoe means mounted to such two opposite sides of each said crosshead slidably supporting the crosshead on its said way means, and other arcuate shoe means mounted to each said crosshead intermediate its said arcuate bearing shoe means, whereby 90° rotation of said crossheads causes said other shoe means to support said crossheads on said arcuate way means.

9. A multi-plunger reciprocating pump according to claim 8, wherein there are an odd number of said cylinders.

10. A multi-plunger reciprocating pump according to claim 8, wherein there are only there of said cylinders.

11. A multi-plunger reciprocating pump according to claim 8, wherein a third said cylinder is disposed at least generally vertically offset from the centerline of said crankshaft, and the one of said first and second cylinders on the opposite side of said centerline from said third cylinder is disposed at least generally between said third cylinder and the one of said first and second cylinders on the same side of said centerline as said third cylinder.

12. A multi-plunger reciprocating pump according to claim 8, wherein said conduit means comprises separate supply conduits for said cylinders and separate discharge conduits for said cylinders, and further comprising inlet manifold means communicating with said supply conduits for all of said cylinders for supplying fluid thereto, and discharge manifold means communicating with said discharge conduits for all of said cylinders for discharging pumped fluid therefrom.

13. A multi-plunger reciprocating pump according to claim 8, wherein said conduit means for each of said cylinders comprises supply conduits for supplying fluid to both ends of the cylinder and also discharge conduits for discharging pumped fluid from both ends of the cylinder, and said valve means comprises valves operatively associated with each of said conduits for controlling fluid flow therethrough, said valves for each of said cylinders being operable to permit supply of fluid to either end of the cylinder while permitting simultaneous discharge of fluid from the other end of the cylinder.

14. A multi-plunger reciprocating pump according to claim 13, further comprising inlet manifold means communicating with said supply conduits for all of said cylinders for supplying fluid thereto, and discharge manifold means communicating with said discharge conduits for all of said cylinder for discharging pumped fluid therefrom.

15. A multi-plunger reciprocating pump according to claim 8, wherein a third said cylinder is disposed vertically offset from the centerline of said crankshaft, the one of said first and second cylinders on the opposite side of said centerline from said third cylinder is disposed at least generally between said third cylinder and the one of said first and second said cylinders on the same side of said centerline as said third said cylinder, there are only said three said cylinders, all of said cylinders are disposed on the same side of said crankshaft, said conduit means for each of said cylinders comprises supply conduits for supplying fluid to both ends of the cylinder and also discharge conduits for discharging pumped fluid from both ends of the cylinder, and said valve means comprises valves operatively associated with each of said conduits for controlling fluid flow therethrough, said valves for each of said cylinders being operable to permit supply of fluid to either end of the cylinder while permitting simultaneous discharge of fluid from the other end of the cylinder, and further comprising inlet manifold means communicating with said supply conduits for all of said cylinders for supplying fluid thereto, and discharge manifold means communicating with the discharge conduits for all of said cylinders for discharging pumped fluid therefrom.

16. A multi-plunger reciprocating pump according to claim 15, wherein said first said cylinder is above said centerline, and said second and third said cylinders are blow said centerline.

17. A multi-plunger reciprocating pump comprising a generally horizontally extending crankshaft at least three generally horizontally extending cylinders, a first of said cylinders being disposed at least generally above the centerline of said crankshaft and a second of said cylinders being disposed at least generally below the centerline of said crankshaft, conduit means operatively associated with each of said cylinders for supplying fluid to, and discharging pumped fluid from, said cylinders, valve means for controlling fluid flow through said conduit means, a piston movably disposed in each of said cylinders for reciprocation therein, and connecting means connecting said crankshaft to said pistons such that rotation of said crankshaft causes driven reciprocation of said pistons in said cylinders, wherein said connecting means for each said piston comprises a connecting rod connected to said crankshaft to be driven thereby, a piston rod connected to the piston, and a crosshead connecting said connecting rod to said piston rod, and further comprising housing means enclosing at least a portion of said crankshaft, and oil pan means mounted within said housing means adjacent the lower side of said crankshaft, for containing lubricating oil; and wherein said oil pan means is detachably mounted within said housing means for selective removal thereof, from said housing means, to facilitate an axial or horizontal removal of said crankshaft from said housing means unobstructed by said oil pan means.

18. A multi-plunger reciprocating pump according to claim 17, wherein said valves are accessible without disconnection of said conduit means.

19. A multi-plunger reciprocating pump according to claim 17, wherein there are only said three said cylinders.

20. A multi-plunger reciprocating pump according to claim 19, wherein said first said cylinder is at least generally above said centerline, and said second and third said cylinders are at least generally below said centerline.

21. A multi-plunger reciprocating pump comprising a generally horizontally extending crankshaft, a plurality of generally horizontally extending cylinders alternately disposed at least generally above and below the centerline of said crankshaft, conduit means operatively associated with each of said cylinders for supplying fluid to, and discharging pumped fluid from, said cylinders, valve means for controlling fluid flow through said conduit means to-and-from said cylinders, a piston movably disposed in each of said cylinders for reciprocation therein, and connecting means connecting said crankshaft to said pistons such that rotation of said crankshaft causes driven reciprocation of said pistons in said cylinders, wherein said connecting means for each said piston comprises a connecting rod connected to said crankshaft to be driven thereby, a piston rod connected to the piston, and a crosshead connecting said connecting rod to said piston rod, and further comprising housing means enclosing at least a portion of said crankshaft, and oil pan means mounted within said housing means adjacent the lower side of said crankshaft, for containing lubricating oil; and wherein said oil pan means is detachably mounted within said housing means for selective removal thereof, from said housing means, to facilitate an axial or horizontal removal of said crankshaft from said housing means unobstructed by said oil pan means.

* * * * *